United States Patent [19]

Byrd, Jr.

[11] 4,186,912

[45] Feb. 5, 1980

[54] ACCIDENT SCREEN

[76] Inventor: Clyde L. Byrd, Jr., 10505 Burman St., Houston, Tex. 77029

[21] Appl. No.: 964,596

[22] Filed: Nov. 29, 1978

[51] Int. Cl.[2] ..... E04H 17/00

[52] U.S. Cl. ..... 256/1; 256/24; 116/63 P

[58] Field of Search ..... 256/1, 13.1, 23, 24, 256/25, DIG. 6, 12.5; 116/63 P, 173; 404/6, 9; 135/5 R

[56] References Cited

U.S. PATENT DOCUMENTS

| | | | |
|---|---|---|---|
| 1,041,173 | 10/1912 | Ryans | 116/173 |
| 2,764,830 | 10/1956 | Frey | 116/63 R |
| 3,347,527 | 10/1967 | Andrews | 256/24 X |
| 4,105,190 | 8/1978 | Curtis | 256/1 |
| 4,124,196 | 11/1978 | Hipskind | 116/63 P |

*Primary Examiner*—Andrew V. Kundrat
*Attorney, Agent, or Firm*—Neal J. Mosely

[57] ABSTRACT

An accident screen kit comprises an elongated fabric screen of light-reflective material, preferably of alternating stripes. The material is in the form of an elongated strip which is supported at each end by a folding post of a light weight tubular plastic material. The posts are each provided with mounting cables for supporting the same in a position obscuring the site of an accident from the view of passing motorists. The fabric is also provided with a plurality of elongated slots which permit passage of air and thus prevent wind damage. The use of this accident screen obscures accident sites and prevents the inevitable slowdown in traffic passing the site of an accident. The accident screen is highly portable and may be handled and erected by one person.

10 Claims, 6 Drawing Figures

ACCIDENT SCREEN

BACKGROUND OF THE INVENTION

1. Field of the Invention

This invention relates to new and useful improvements in screens for obscuring accident sites.

2. Brief Description of the Prior Art

It is well known by safety officials and police officers concerned with safety and with maintaining the flow of motor vehicle traffic that many traffic jams and secondary accidents are attributable to the slowdown and jamming of traffic at accident sites. Whenever an accident occurs, it not only slows traffic in the traffic lane where the accident occurs, but also results in the slowing of traffic in the opposite lane as a result of motorists slowing to look at the site of the accident.

At the present time, no equipment is available to obscure the site of an accident. The closest thing to an accident-obscuring screen would be the use of a blanket or tarpaulin to cover a body of a deceased or injured person lying on the ground.

Collapsible fences and screens are known for temporary use in obscuring athletic fields, playgrounds, building sites and the like. However, no portable screens are known to be available of a size and construction capable of being carried and erected by a single individual at the site of an accident.

SUMMARY OF THE INVENTION

An object of this invention is to promote highway safety and free flow of highway traffic by providing means to obscure the site of an accident.

Another object of this invention is to promote highway safety and free flow of motor vehicle traffic by providing an accident screen in the form of a collapsible kit including supporting posts and an elongated fabric screen for obscuring an accident site.

An accident screen kit comprises an elongated fabric screen of light-reflective material, preferably of alternating stripes. The material is in the form of an elongated strip which is supported at each end by a folding post of a light weight tubular plastic material. The posts are each provided with mounting cables for supporting the same in a position obscuring the site of an accident from the view of passing motorists. The fabric is also provided with a plurality of elongated slots which permit passage of air and thus prevent wind damage. The use of this accident screen obscures accident sites and prevents the inevitable slowdown in traffic passing the site of an accident. The accident screen is highly portable and may be handled and erected by one person.

DESCRIPTION OF THE PREFERRED EMBODIMENT

Figure 1:
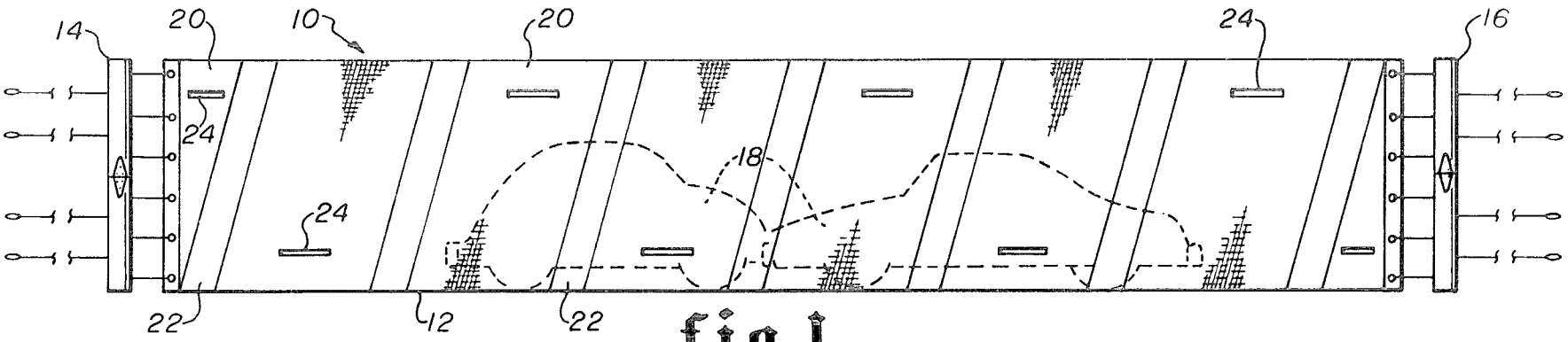
FIG. 1 is a view in elevation of the accident screen of this invention illustrated in position of normal usage.
Figure 4:
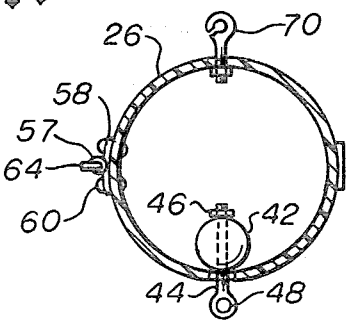
FIG. 4 is a view in horizontal cross section taken on the section line 4—4 of FIG. 3.
Figure 6:
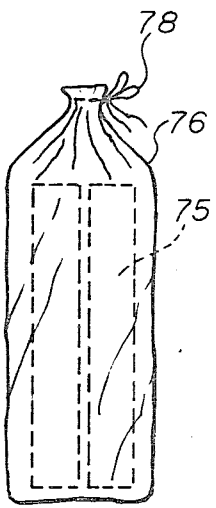
FIG. 6 is a schematic view of the accident screen of FIG. 1 rolled up for storage and contained in a carrying bag.

Referring to the drawings by numerals of reference, and more particularly to FIG. 1, there is shown an accident screen 10 comprising an elongated strip of fabric 12 supported by end posts 14 and 16 to obscure the site of an accident as indicated by the dotted outline 18 of a wrecked motor vehicle. The elongated strip of fabric 12 is five feet wide by thirty-six feet long or larger, as needed. The strip of fabric 12 is constructed of alternate panels 20 and 22, respectively, which are of a reflective material for safety. Panel 20 is preferably of a safety-orange reflective material, while panel 22 is preferably of a white reflective material. Obviously, other colors could be used so long as they provide an adequate warning. It is essential that suitable safety striping be used with alternate colors or colors alternating with white, of a highly reflective material, to provide an adequate warning of a possible hazard. The strip of fabric 12 is also provided with a plurality of slots 24 which allow the wind to blow through the panels and protect the fabric screen against wind damage. The details of the supporting posts 14 and 16 and the method of attachment of the fabric screen thereto and the method of support for the posts is illustrated in FIGS. 2 to 4.

Figure 2:
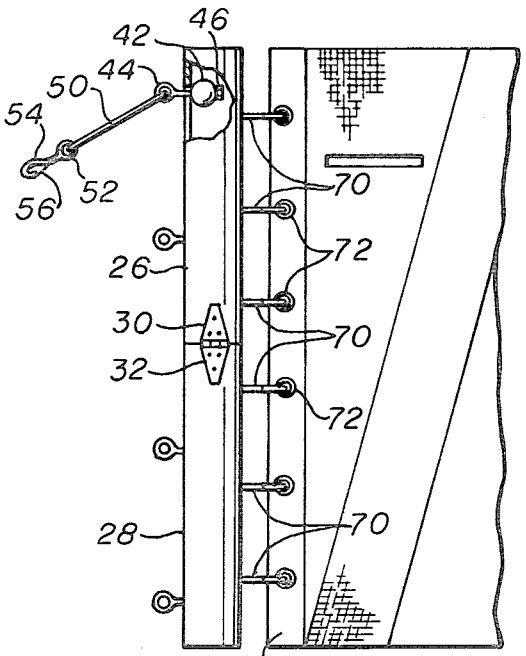
FIG. 2 is a view in elevation of one of the collapsible supporting poles for the accident screen shown in FIG. 1.

In FIG. 2, there is shown more detail with respect to the construction of supporting post 14. Supporting post 16 is constructed identically to post 14 but is turned over, end for end, in making the connection to the opposite end of the strip of fabric 12.

Post 14 consists of two sections, 26 and 28, of hollow plastic tubing. The sections of tubing 26 and 28 are preferably three feet long, three inch O.D., and forty gauge wall thickness plastic tubing (preferably polypropylene) or the like. Tubing sections 26 and 28 are connected together by hinge 30 which is secured in place by a plurality of screws 32 or the like.

Figure 3:
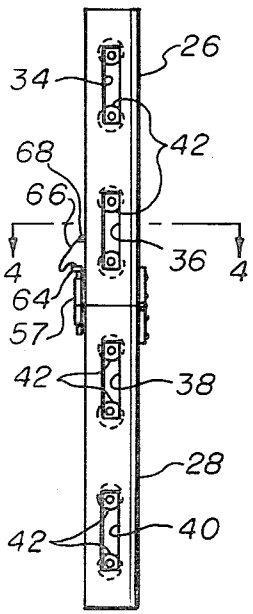
FIG. 3 is a view in end elevation of one of the collapsible poles as shown in FIG. 2.

In FIG. 3, there is shown an end view or left elevation of post 14. In this view, it is seen that upper tubing portion 26 is provided with a pair of slots 34 and 36 and lower tubing portion 28 is provided with a pair of slots 38 and 40. These slots are preferably about one fourth inch wide by twelve inches long. Inside the tubing portions 26 and 28 there are positioned a plurality of balls 42 which secure one end of each of the cables used to support the respective posts. Ball 42 is of wood or plastic or the like and is drilled to receive an eye bolt 44. Eye bolt 44 is secured in ball 42 by nut 46 or the like. Eye bolt 44 has an eyelet 48 at the opposite end and has one end of cable 50 secured therein. Each of the cables 50 (8 cables being provided) is connected to an eye bolt secured in one of the balls 42. The opposite end of each cable is secured to the eyelet end 52 of a safety hook 54 which has a spring closure 56. The balls 42 which support the cable are preferably about one inch to one and one-half inch diameter. The cable 50 is preferably three-sixteenth inch steel cable which is three feet in length. Upper tube 26 is provided with a one-fourth inch I.D. by four inch long tube 57 which may be secured on a backing plate 58 and secured by screws 60 to tube 26 adjacent the hinged end thereof. The lower tube 28 is provided with a one-fourth inch I.D. by four inch long tube secured adjacent the hinged end in the same manner as tube 56 and aligned therewith. Tubes 56 and 62 are aligned when tubes 26 and 28 are in the position shown in FIGS. 2 and 3. Tubes 57 and 62 receive a retaining pin 64 which is supported on a steel cable 66 and secured to upper tube 26 as indicated at 68.

On the side of tubes 26 and 28 opposite the slots, there are provided a plurality (preferably 6) of slip hooks (eye bolts with spring loaded opening portions) 70. Slip hooks 70 are secured in the wall of tubing 26 or 28 by threaded connection or by a bolt and washer retaining the slip hook in the desired position. Slip hooks 70 are fitted into grommets 72 in the hemmed end portion 74 of the fabric strip 12.

Figure 5:
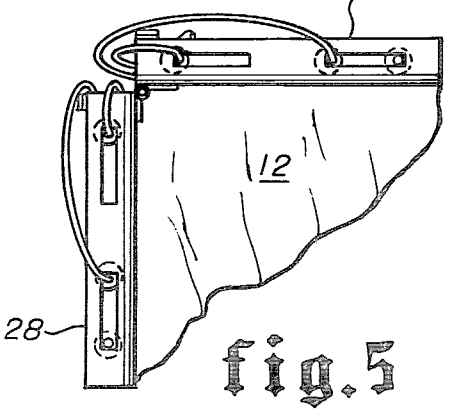
FIG. 5 is a view of the accident screen shown in FIG. 1 in the process of being folded up.

When this safety screen is broken down it is folded at each end. The view in FIG. 5 shows intermediate position in the folding of the equipment. When folded, the posts are then rolled up in the fabric strip 12 and are preferably supported as a roll 75 in a fabric bag 76 provided with a drawstring closure 78.

OPERATION

The manner of use and operation of this equipment should be obvious from the foregoing description. However, a more detailed description of its purpose and manner of use will be provided for clarification.

It is well known among highway safety officials and police officers concerned with traffic safety that one major cause of traffic jams, and in some cases the cause of secondary accidents, is the slowing of traffic to look at the site of an accident. When an accident occurs on or near a highway, it not only tends to slow the traffic in the land adjacent the accident, but also causes the traffic moving in the opposite direction to slow as a result of drivers wishing to see what has happened. It is a common sight on major highways for an accident to occur and immediately cause traffic to back up in the immediate vicinity of the accident. Almost immediately, the traffic will begin to back up in the lane moving in the opposite direction from the accident as well as in the lane of traffic in which the accident has occurred. The safety screen which is described above is capable of erection by one person and is easily carried by a safety official or traffic police officer to the site of an accident. The equipment is light and portable and easy to erect. The dimensions and sizes for the various components given above are merely illustrative and may obviously be varied for different areas of intended use. The dimensions given are suitable for use in obscuring the site of most traffic accidents.

On reaching the site of an accident, the police officer, or other safety official, would remove the roll 74 of equipment from bag 76 (or other carrying case) and unroll it to its full length. The supporting posts 14 and 16 are each then unfolded to a fully straightened out position as shown in FIGS. 1, 2 and 3. It should be noted that the supporting cables 50 are stuffed inside the hollow tube portions 26 and 28 during storage. These cables are, of course, removed before the posts are erected. When the posts are straightened out, as shown, the strip of fabric 12 is opened as indicated in FIGS. 1. It should be noted that the hinges 30 on posts 14 and 16 cause the folding of posts 14 and 16 in a direction resulting in the reflective surface of the strip of fabric 12 being folded to the inside. When the posts 14 and 16 are erected, as shown, retaining pin 64 (which hangs loose on cable 66) is inserted through aligned tubes 57 and 62 to secure the tubing portions 26 and 28 in an erected position.

The accident screen is then placed over and/or around the site of the accident to obscure it from the view of passing traffic. The cables 50 (8 cables being provided for each of the posts 14 and 16) are then pulled out to full length and are attached to any convenient fixed object to support posts 14 and 16, respectively, in an erected position. The cables can be attached to a tree or telephone pole or building or another motor vehicle or any suitable fixed object. The cables are easy to attach by means of the spring hooks 54 which permit direct attachment to any suitable object or by looping the end of the cable around an object and hooking the cable back on itself. The substantial number of cables provided permits attachment to a variety of different fixed objects or fixed positions to steady the posts 14 and 16 in a vertical (or other suitable) position. The posts may be supported with the fabric stretched taut, as shown in FIG. 1, or, if necessary, the fabric may be draped around the accident site and the posts hooked to each other.

The strip of fabric 12 is made of light reflective material and alternates in safety stripes, preferably alternating orange and white. This is effective to obscure the site of the accident and yet provides a warning to prevent a further accident by another vehicle running through the barrier screen. As noted above, the fabric 12 is provided with slots 24 which permit the wind to blow through the screen without revealing the nature of the object behind the screen. This equipment is large enough to obscure an entire accident site including one or more motor vehicles as well as any deceased or injured persons lying about.

When the need for the accident screen has passed, the supporting cables 50 are disconnected. Retaining pins 64 are removed from tubes 56 and 62 to permit posts 14 and 16 to be broken down. Posts 14 and 16 are then folded at hinges 30, as seen in FIG. 5, and the screen fabric 12 is folded lengthwise with the reflective surface folded inward. Cables 50 are stuffed into the end of tubes 26 and 28 for storage. The folded supporting posts are then rolled up in the folded screen fabric 12 into a roll 74 and placed in bag 76 (or other suitable container) for storage.

While this invention has been described fully and completely, with special emphasis upon a single preferred embodiment, it should be understood that, within the scope of the appended claims, the invention may be practiced otherwise than as specifically described herein.

I claim:

1. An accident screen for obscuring the site of motor vehicle or other accident comprising an elongated screen strip of highly light reflective fabric in suitable safety colors, a pair of supporting posts secured to opposite ends of said fabric strip, each of said posts being formed of two sections of substantially equal length, a pair of hinges, one for each post, secured to said post sections to permit said posts to be folded for storage, means to secure said post sections against folding when unfolded in an erect position, a plurality of supporting cables secured to and supported on each of said post section and adjustable in position longitudinally of said sections, and said posts being operable, when erect, to support said screen strip to obscure an accident site, and when folded, to be wrapped into a roll for storage.

2. An accident screen according to claim 1 in which said elongated screen strip is formed of a plurality of alternating panels of reflective material of different colors.

3. An accident screen according to claim 1 in which said supporting cables are secured to separate supporting means supported on and slidable longitudinally of said post sections.

4. An accident screen according to claim 1 in which said screen strip had a plurality of elongated narrow slots therein to permit passage of wind therethrough.

5. An accident screen according to claim 1 in which said supporting posts are hollow tubes.

6. An accident screen according to claim 5 in which said hollow tubes have longitudinally extending slots therein positioned 90° from said hinges.

7. An accident screen according to claim 6 in which a plurality of retaining balls are positioned in said tubes with each cable being secured to one of said balls and extending through one of said slots.

8. An accident screen according to claim 6 or claim 7 which includes a plurality of hooks supported on said tubes on the side opposite said slots, and the end of said screen strip including a plurality of grommets in which said hooks are secured to support said strip.

9. An accident screen according to claim 7 in which said elongated screen strip is formed of a plurality of alternating panels of reflective material of different colors, and said strip has a plurality of elongated narrow slots therein for passage of wind therethrough.

10. An accident screen according to claim 1 with said posts folded and said fabric folded longitudinally with the light reflective surface on the inside and said posts being rolled in said folded fabric strip for storage and carrying.

* * * * *